United States Patent [19]

Ohba et al.

[11] 4,338,598

[45] Jul. 6, 1982

[54] THIN-FILM EL IMAGE DISPLAY PANEL WITH POWER SAVING FEATURES

[75] Inventors: Toshihiro Ohba; Shuhei Yasuda; Yoshiharu Kanatani, all of Tenri, Japan

[73] Assignee: Sharp Kabushiki Kaisha, Osaka, Japan

[21] Appl. No.: 110,214

[22] Filed: Jan. 7, 1980

[51] Int. Cl.[3] ..... G09G 3/30

[52] U.S. Cl. ..... 340/713; 340/781; 340/789; 340/825.81

[58] Field of Search ..... 340/713, 781, 166 EL, 340/766, 714, 789

[56] References Cited

U.S. PATENT DOCUMENTS 3,765,011 10/1973 Sawyer et al. ..... 340/713

4,152,626 1/1979 Hatta et al. ..... 340/166 EL 4,237,456 12/1980 Kanatani ..... 340/781

*Primary Examiner*—Marshall M. Curtis

*Attorney, Agent, or Firm*—Birch, Stewart, Kolasch and Birch

[57] ABSTRACT

A thin-film EL display panel has a plurality of scanning side electrodes and a plurality of data side electrodes. The thin-film EL display panel is excited to emit light through a pre-charge mode, a discharge modulation mode and a write mode. A voltage lower than a modulation voltage is supplied from the data side electrodes to the thin-film EL display panel as a first pre-charge voltage. Thereafter, a difference voltage between the first pre-charge voltage and the modulation voltage is supplied from the scanning side electrodes to the panel as a second pre-charge voltage, thus reducing power consumption to a minimum during the pre-charge mode.

3 Claims, 8 Drawing Figures

THIN-FILM EL IMAGE DISPLAY PANEL WITH POWER SAVING FEATURES

BACKGROUND OF THE INVENTION

The present invention relates to an image display through the utilization of a double-isolated thin-film EL display panel, and more particularly to its features of power savings.

It is therefore an object of the present invention to provide means for saving power incurred within a thin film EL display panel. According to a display device embodying the present invention there is provided a thin film EL display panel having a family of scanning side electrodes and a family of data side electrode; a first circuit adapted for supplying a voltage less than a modulation voltage from said data side electrodes to said thin-film EL display panel as a pre-charge voltage; a second circuit adapted for supplying a differential voltage between said supply voltage and said modulation voltage from said scanning side electrodes to said thin-film EL display panel as another pre-charge voltage; and a third circuit adapted to supply a write voltage to selected ones of the scanning side electrodes inclusive of picture elements to be written, via a scanning side switching circuit and a data side switching circuit, respectively, connected to the selected ones of the scanning side electrodes inclusive of the picture elements to be written and a data side switching circuit.

BRIEF DESCRIPTION OF THE DRAWINGS

Other objects and many of the attendant advantages of the present invention will be readily appreciated as the same becomes better understood by reference to the following detailed description which considered in conjunction with the accompanying drawings, and wherein.

DETAILED DESCRIPTION OF THE INVENTION

In order to give a better understanding of the present invention, a brief description will first be made with reference to FIG. 1, of construction of a double-isolated thin-film EL (electroluminescent) panel useful for the present invention.

Figure 1:
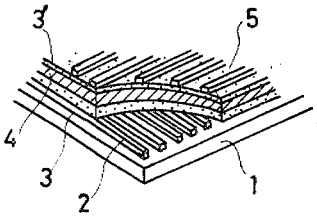
FIG. 1 is a fragmentary perspective view of a thin-film EL display panel.

As seen from FIG. 1, a thin-film EL display panel has a three-layered structure. A predetermined number of transparent electrode strips 2 are disposed on a glass support 1. A layer 3 of dielectric material such as $Y_2O_3$, a layer 4 of electroluminescent material, for example, ZnS doped with Mn (yellowish orange light) and a second layer 5 of dielectric material such as $Y_2O_3$, $SiN_4$, $TiO_{2l}$, $Al_2O_3$ are further disposed by a well known thin-film technique such as vacuum deposition and sputtering, each having a thickness ranging from 500 to 1000Å.

This results in a double-isolation three-layered structure of the EL display panel. A different family of strip electrodes 6 is disposed in a direction normal to the direction of the transparent electrodes 2 to form an electrode matrix array together with the transparent electrodes. With such a three-layered thin-film EL display panel, if one of the first family 2 of the electrodes and one of the second family 6 of the electrodes are selected, the minute area where selected ones of the electrodes are crossed will emit light. This corresponds to a picture element of an image like a character, a symbol and a pattern being displayed. The EL panel with such structure is more attractive than the prior art dispersed powder type EL panel from the standpoint of light intensity, working life and performance stability.

Figure 2:
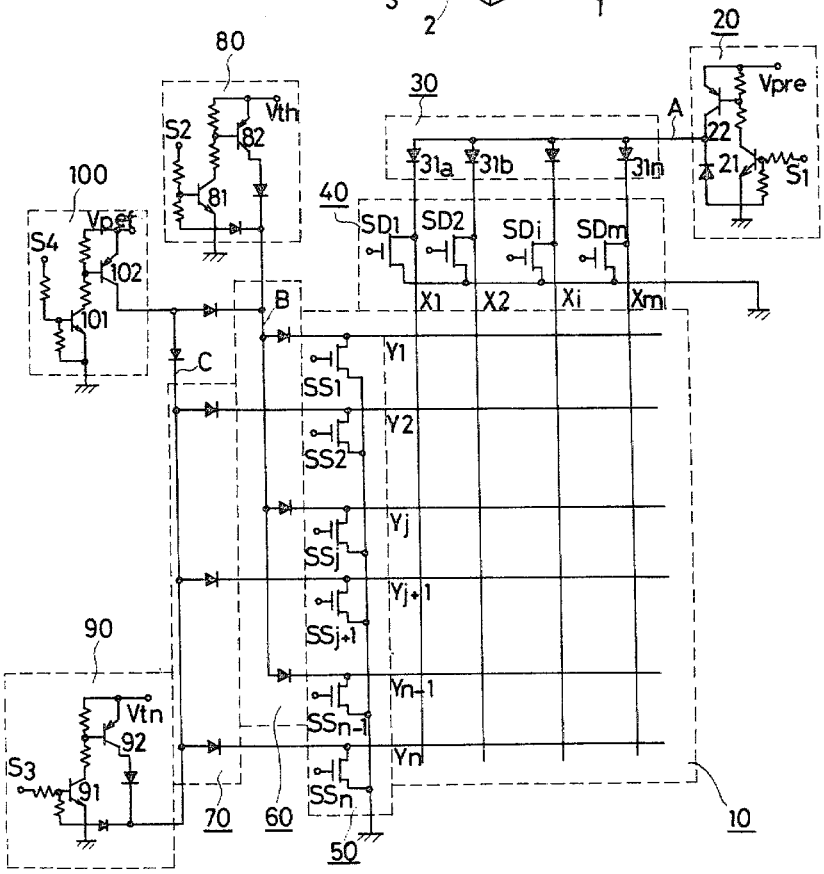
FIG. 2 is a circuit diagram of an EL panel drive circuit construction embodying the present invention.
Figure 3:
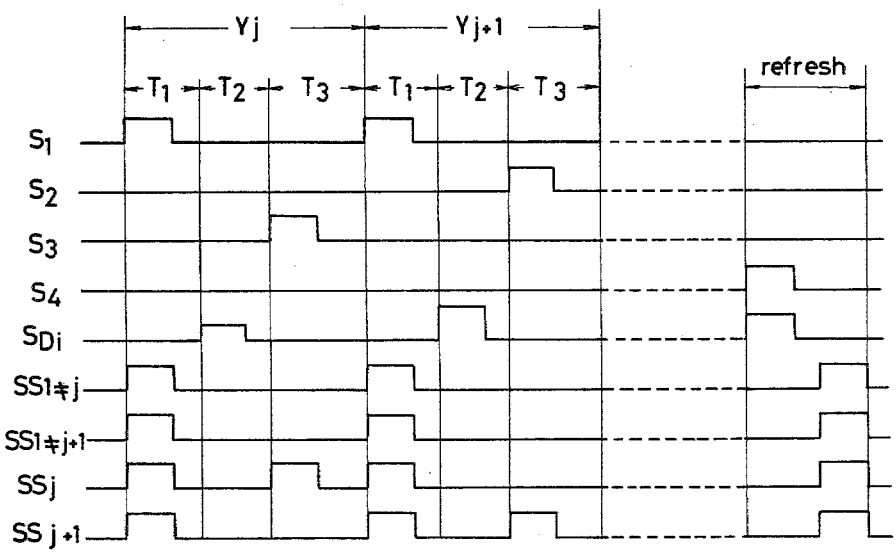
FIG. 3 is a time chart of the circuit of FIG. 2.

The thin-film EL display panel can be regarded as a capacitive element since it includes the EL layer sandwiched between the dielectric layers 3, 3'. Through the utilization of such capacitive nature of the EL display panel, it is possible to implement an EL panel driver with only one kind of transistor such as N-channel MOS transistors or NPN type transistors. FIGS. 2 and 3 are circuit diagrams and a time chart showing such a driver circuit.

In FIG. 2, the above described thin-film EL display panel is labeled 10 wherein electrodes $X_1$–$X_m$ in the X direction serve as date electrodes and electrodes $Y_l$–$Y_n$ in the Y direction serve as scanning electrodes. Only these electrodes of the thin-film EL display panel are depicted in the drawings. An enable circuit 20 wherein respective ones of diodes $31_1$, $31_2$, . . . $31_m$ are connected to the common line A at the anodes thereof and to the respective electrodes $X_l$–$X_m$ at the cathodes thereof. The effects of the diode array 30 are to provide isolation for respective data lines and protect switching elements consisting of high voltage transistors from being reverse biased.

Figure 4:
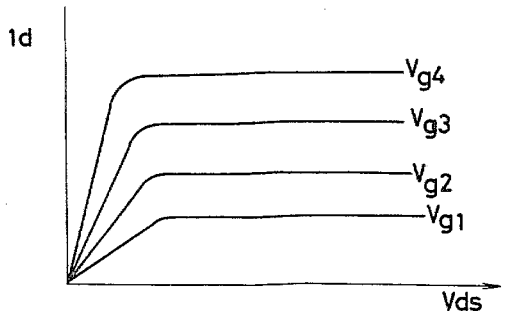
FIG. 4 is a voltage-current characteristic graph of an element used in the circuit of FIG. 2.

A data side switching circuit 40 includes scores of N-channel MOS transistors connected between respective ones of the X electrodes and the ground level, forming a circuit which discharges a charge accumulated on non-selected picture elements. These transistors serve as constant current drive elements bearing a predetermined relationship between the input voltage and the output current as depicted in FIG. 4 with the abscissa indicating the source-drain voltage $V_{ds}$ and the ordinate indicating the drain current ID varying as a function of the gate voltage $V_g$.

A scanning switch element circuit 50 including N channel MOS transistors is connected to the scanning electrodes $Y_l$–$Y_n$ and the ground potential, which supplies a write voltage to selected ones of the picture elements to be written.

A diode array 60 is provided with the respective cathodes thereof connected to odd Y electrodes and the respective anodes thereof connected in common, for the purpose of isolating the scanning drive lines from one another and preventing those switching elements from being reverse biased.

Another diode array 70 is provided with the respective cathodes thereof connected to even Y electrodes and the respective anodes thereof connected in common for the same purpose.

A driver circuit 80 brings the common electrode B of the diode array 60 up to a threshold voltage $V_{th}$ through transistors 81 and 82 responsive to a write signal $S_2$. Another drive circuit 90 supplies the even scanning drive lines with the same voltage $V_{th}$ through transistors 91 and 92 responsive to a write signal $S_3$.

A driver circuit 100 supplies a refresh pulse voltage to the whole of the thin-film EL display device by supplying the same to the common lines B, C of the diode arrays via transistors 101 and 102 responsive to a signal $S_4$, subsequent to the completion of a one-field scan.

By reference to a flow chart of FIG. 3, the mode of operation will be now described.

FIRST STAGE $T_1$: PRE-CHARGE

The gates to all the scanning side switching elements $SS_1$–$SS_n$ within the circuit 50 are supplied with a high level signal SET, so that all the switching elements are placed into the ON state. Since the driver circuit 20 is supplied on the common line A with a voltage $V_{pre}$, all the picture elements on the thin-film EL display panel are charged with the voltage $V_{pre}$ via all the data lines $X_l$–$X_m$. The voltage $V_{pre}$ is correlated as $V_{Pre}=V_w-V_{th}$ wherein $V_w$ is the electroluminescent voltage of the thin-film EL display panel and $V_{th}$ is the threshold voltage $V_{th}$ thereof.

SECOND STAGE $T_2$: DISCHARGE MODULATION

All the transistors $SS_l$–$SS_n$ within the scanning side switching circuit 50 are rendered nonoperative. The transistors within the demodulation driver circuit 40, leading to non-selected picture elements, are selected so as to enable the transistors $SD_l$–$SD_m$ in a constant current fashion in relation to their input and output relationship. The charge accumulated during the first step is thus discharged in the constant current fashion. Discharge current id following through the output of a specific transistor $SD_i$ in the circuit $SD_i$ can be represented below:

$$id = -C\frac{dv}{dt} \tag{1}$$

wherein C is a sum of capacitances of respective lines viewed from the modulation side drive lines $X_l$–$X_m$ and is equal to C=nCe (Ce: capacitance per picture element of the matrix panel and n: the number of all the picture elements).

Since the transistors $SD_l$–$SD_m$ are of the constant current type, the discharge voltage V per unit time can be written below:

$$V = \int_0^{\tau} -\frac{id}{C}\,dt = V_p - \frac{id}{C} \tag{2}$$

wherein $\tau$ is the discharge period.

Assume now that an N channel MOS transistor having the relationship between the input gate voltage $V_g$ and the drain current id as defined below is employed as a constituent element in the modulation side driver circuit 40:

$$iD=gmVg \tag{3}$$

wherein gm is the gate-to-drain mutual conductance of the transistor employed and a proportional constant.

Where $V_g(i)$ is the input gate voltage of the constant current type drive element SDi driving a specific drive line Xi connected to the modulation side drive circuit 40 and gm(i) is the mutual conductance thereof, the voltage V(i) of the drive line Xi following application of the voltage Vg(i) to the gate of that transistor SDi will be rewritten from the foregoing formulas (2) and (3):

$$V(i) = V_{pre} - \frac{id}{C} = V_{pre} - \frac{id}{C} = V_{pre} - \frac{gm(i)}{C}\cdot V_g(i) \tag{4}$$

wherein iD is the drain current and equal to the discharge current iD.

In as much as the mutual conductance gm of the elements $SD_l$–$SD_m$ in the circuit 40 is much less different from element to element, gm(i)÷gm (K≠i)=gm is satisfied and gm/C is deemed as the constant K. Formula (4) can be rewritten as the following one (5):

$$V(i)=V_{pre}-K.V_g(i).\tau \tag{5}$$

Formula (5) reveals that the input gate voltage $V_g(i)$ of the drive element SDi and the period $\tau$ of the input gate voltage applied are two parameters for determining the voltage V(i).

Accordingly, a way to provide a visual display of a half-tone image by amplitude modulation for the thin-film EL display panel consists either applying a signal having the variable amplitude corresponding to the video signal for a specific period to the input of the constant current type drive element or applying a signal having the fixed voltage amplitude but the variable pulse width corresponding to the video signal to the input of the constant current type drive element. The former is named the amplitude modulation drive method by the amplitude modulated input signal and the latter is named the amplitude modulation drive method by the pulse width-modulated input signal.

The amplitude modulation drive method by the amplitude-modulated input signal is executed in a way that a signal variable in voltage according to the video signal is applied to the gate of the transistor SDi. The amplitude modulation drive method by the pulse width-modulated input signal is executed through the utilization of a signal variable in pulse width according to the video signal, which pulse width variable signal is applied to the transistor SDi.

A picture element to be written is charged previously with a voltage corresponding to the magnitude of the video signal in this way during the second step.

THIRD STAGE $T_3$: WRITE

All the transistors $SS_l$–$SS_n$ in the scanning side switch circuit 50 and all the transistors $SD_l$–$SD_m$ in the data side switch circuit 40 should assume the OFF state. Under the circumstance the modulation side drive electrodes $X_l$—$X_m$ are held or clamped with the voltages V(i), (i=1,2, . . . m) corresponding to the inputs to the modulation side elements $SD_l$—$SD_m$.

Only the transistors $SS_j$ enabling a selected one of the scanning electrodes $Y_j$ is turned ON in response to the output from the digital shift register 14-1, while all the remaining scanning drive elements $SS_{k\neq j}$ still stand in the OFF state. If the scan electrode Yj is odd at this moment, then the write drive circuit 90 upon application of the write command WP will bring the common line C of the diode array 70 connected to the even scan electrodes up to the electroluminescence threshold voltage level Vth. The voltages $V_w(i)$, (i=1, 2, . . . m) of the modulation side electrodes $X_l$–$X_m$ become below since the write mode is carried out so as to increase all the scanning side electrodes $Y_{k\neq j}$ except the selected scan electrode Yj up to the electroluminescence threshold voltage $V_{th}$:

$$V_w(i) = V(i) + V_{th} \quad (6)$$

The transistor associated with the selected scan electrode Yj is in the ON stage so that the picture element E (i,j) on the selected scan electrode Yj causes electroluminescence in proportion to the write voltage $V_{w(i)}$ upon supply of the voltage as defined by formula (6). Meanwhile, the voltage V(i) is supplied to the picture elements E(i, k≠j) on the non-selected scan electrode $Y_{k\neq j}$.

In order that the selected picture element on the selected scan electrode Yj causes electroluminescence and the non-selected picture elements on the non-selected scan electrodes $Y_{k\neq j}$ do not cause electroluminescence, the respective voltages of the common line drive circuits 11, 18, 19 should be correlated as follow. In the given example, $V_p = 1/3\ V_{th}$.

$$V(i) \leqq V_{pre} \leqq V_{th} \leqq V_{w(i)} \quad (7)$$

The picture element on the selected scan electrode Yj is written via the above described three stages.

After the completion of the write mode on the odd scanning electrodes, the first step $T_1$ (pre-charge) and the second step $T_2$ (discharge modulation) are carried out in the same way described above in order to write in sequence the even scanning electrodes. During the third step $T_3$ (write) the scanning electrode $U_{j+i}$ is selected and the common line B of the diode array 60 connected to the odd scanning electrodes is brought up to the threshold voltage $V_{th}$ by use of the write circuit 80 in order to execute the write mode on the even scanning electrodes.

The odd and even scanning electrodes are written in sequence through repetition of the first, second and third steps.

Subsequent to the completion of the sequential scanning the half-tone one-field write mode field refresh pulses are supplied via a drive circuit 100 and a diode array circuits 60 and 70. All of the transistors $SS_l$–$SS_n$ within the scanning side switching circuit 50 are in the OFF state while all of the transistors $SD_l$–$SD_m$ within the data side switching circuit 40 are in the ON state.

The voltage of the field refresh pulses is equal to the write voltage of a sufficient level to ensure a maximum brightness and to be applied to the respective scanning electrodes and thus applied to the thin-film EL display panel in a direction opposite to that of the write voltage. Accordingly, the thin-film EL display panel is supplied alternatively with the write voltage and the field refresh pulses. Since the picture elements supplied already with the write voltage have been electrostatically polarized when the field refresh pulses are applied, an electric field resulting from this polarization is superimposed on that resulting from the application of the field refresh pulses, thus energizing only the already written picture elements to emit light. Since the degree of the polarization of the already written picture elements is proportional to the brightness, a half-tone display corresponding to the degree of the polarization is possible when the field refresh pulses are applied. The field refresh pulses are also of use in avoidng biased polarization and making possible the emission of light from the written picture elements when the write voltage is applied during the next succeeding field.

The respective voltage and pulse constants can be selected as follows in the given example:

$V_{pre} = 70$ (volts)
$V_{th} = 140$ (volts)
$-V_r = -210$ (volts)
the width of applied pulses: 40 (msec)
the length of each field: 16.7 (msec)

It will be noted that, although in the above illustrated embodiment the write circuits 80 and 90 supply the threshold voltage $V_{th}$, they may be modified to supply a less than threshold voltage. In this case there is then the need to increase the supply voltage of the drive circuit 20 by the balance voltage which is between the supply voltage and the threshold voltage. The supply voltage of the driver circuit 20 need not exceed the threshold voltage of electroluminescence.

In the case where the thin-film EL display panel manifests hysteresis loop characteristics between applied voltage and brightness, the write mode can be executed in the same manner as in the above illustrated embodiment.

Further, the thin-film EL display panel may be sustained by changing the supply voltage from the drive circuits 80 and 90 to a sustain voltage or providing an additional driver circuit which supplies the sustain voltage. In order to execute the sustain mode in an alternating fashion, it is necessary to provide the data side scanning electrodes with a circuit which supplies the sustain voltage of an opposite polarity. The thin-film EL display panel can be erased by changing the supply voltages of the drive circuits 80 and 90 to an erase voltage or providing an additional drive circuit which supplies the erase voltage.

Power consumption incurring within the above shown circuit at the time of the pre-charge is represented by $CV^2$ Pre wherein C is the overall capacitance of the thin-film EL display panel.

Figure 5:
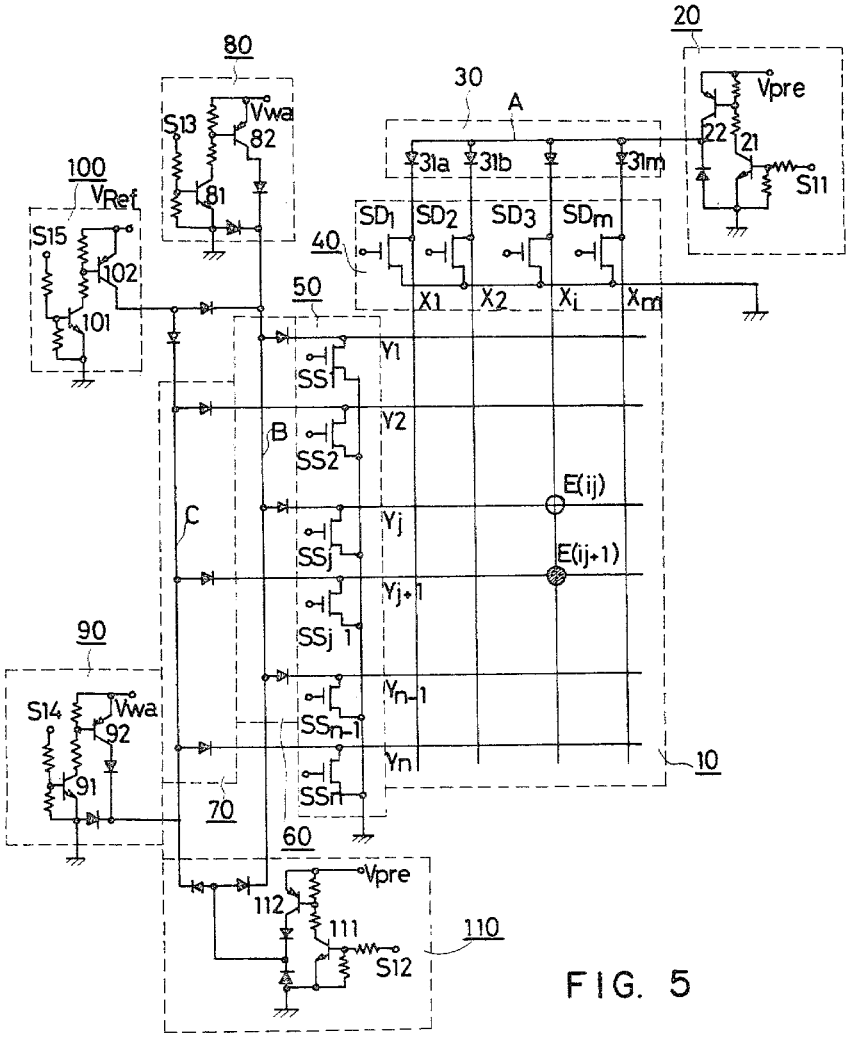
FIG. 5 is a circuit diagram of a thin-film EL display driver in one preferred form of the present invention.

FIG. 5 shows an embodiment of the present invention capable of reducing power consumption to one half at the time of pre-charge, wherein similar parts to those in FIG. 2 are indicated by similar symbols. In other words, the supply voltage $V_{wa}$ of the circuits 80 and 90 is intermediate the threshold voltage $V_{th}$ of electroluminescence and the maximum brightness voltage Vo $$\left(\text{e.g., } \frac{V_{th} + V_o}{2}\right).$$

A circuit 110 supplies the pre-charge voltage $V_{pre}$ from the scanning electrode side via common lines B and C and includes transistors 111 and 112 operable in response to a signal $S_{12}$.

Figure 6:
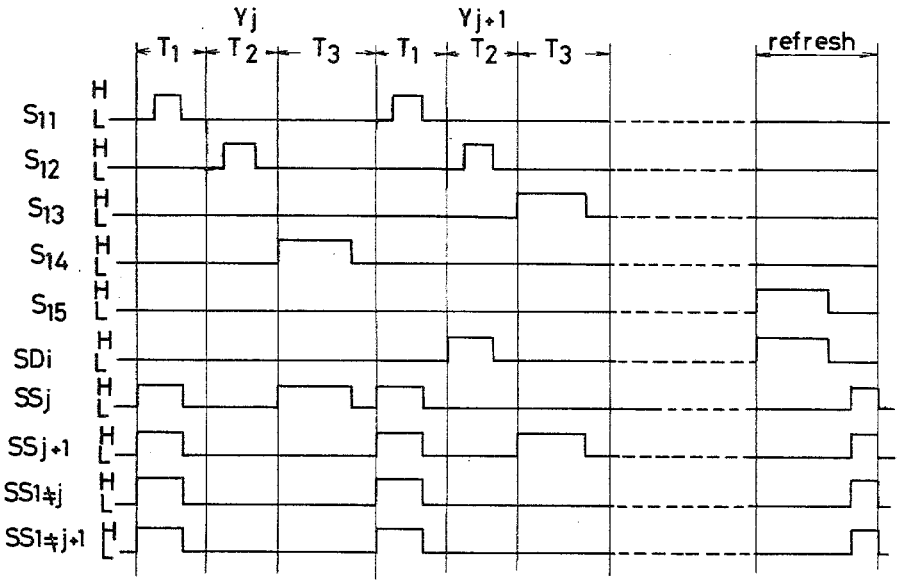
FIG 6 is a time chart of the circuit of FIG. 5.
Figure 7:
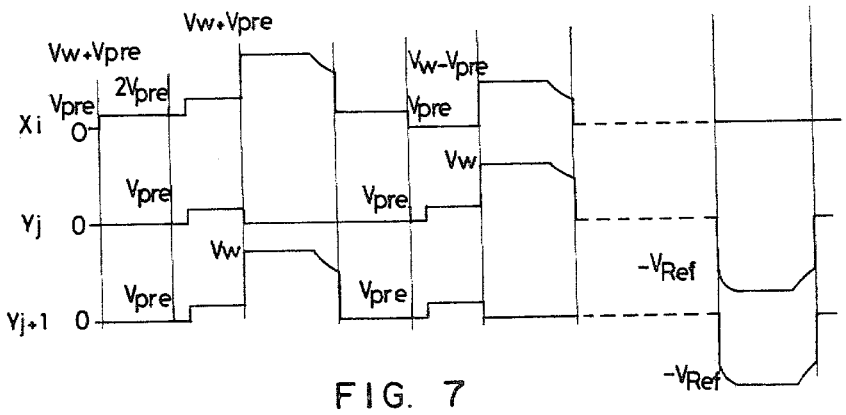
FIG. 7 is a further time chart of the circuit of FIG. 5.

Details of operation of this circuit will be explained by reference to flow charts of FIGS. 6 through 8.

FIRST STEP $T_1$: PRE-CHARGE

The gates of all of the scanning side switching elements $SS_l$–$SS_n$ within the circuit 50 are supplied with a high level signal and stand in the ON stage. When this occurs, all of the MOS transistors within the data side switching circuit 40 are in the OFF stage. A signal supplied to the input terminal $S_{11}$ of the drive circuit 20 renders the transistors 21 and 22 ON and supplies the common line A of the circuit 30 with the pre-charge voltage $V_{pre}$.

As a result, all of the picture elements on the thin-film EL display panel are supplied with the voltage $V_{pre}$ from the data lines $X_l$—$X_m$, the voltage being correlated as $2V_{pre}-V_o-V_{th}$ wherein $V_o$ is the maximum brightness voltage of the thin-film EL display panel and $V_{th}$ is the threshold voltage of electroluminescence.

SECOND STEP $T_2$: DISCHARGE DEMODULATION AND PULLING UP OF SCANNING SIDE

All the MOS transistors $SS_l$-$SS_n$ within the scanning side switching circuit 50 are turned OFF and only the MOS transistors $SD_k$ ($k \neq j$) connected to the non-selected picture elements within the data side switching element array are turned ON whereas the MOS transistors SDi connected to the selected picture elements E (i,j) are held ON. At the time those MOS transistors $SD_k$ are turned ON the input terminal $S_{12}$ of the scanning side pre-charge circuit 110 is supplied with the signal so that the transistors 111 and 112 are turned ON to supply the common lines B and C of the circuits 60 and 70 with the voltage $V_{pre}$ and pull up all the picture elements from the scanning side.

THIRD STEP $T_3$: WRITE

Assume now that the specific picture element E(i,j) in FIG. 5 is to be written. The signal is applied to the input terminal $S_{14}$ of the circuit 90 so as to pull the common line C of the circuit 70 not connected to that selected picture element up to the write voltage $V_w$.

At this moment only the MOS transistor SSj on the scanning side of the picture element E(i,j) is turned ON while the other scanning side MOS transistors SSl are held OFF. All of the data side MOS transistors, on the other hand, are maintained in the OFF state. Through the write mode all of the scanning side electrodes except the selected scanning electrode Yj are brought up to the intermediate voltage level $$V_w = \frac{V_{th} + V_o}{2}$$

(intermediate the electroluminescence initiating voltage $V_{th}$ and the maximum brightness voltage Vo).

Figure 8:
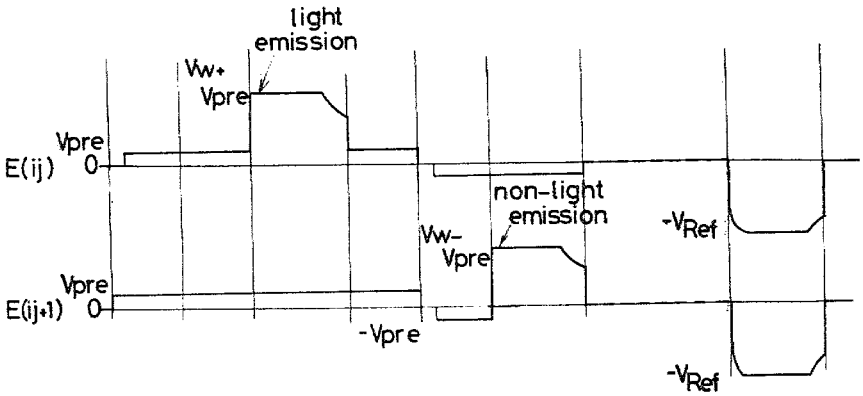
FIG. 8 is another time chart of the circuit of FIG. 5.

During the first through third steps the respective ones of the picture elements on the selected scanning electrodes are supplied with the voltage $V_w+V_{pre}$ when they are desired to emit light, as viewed from applied voltage waveforms in relation to the picture elements E (i,j) and E(i, J+1) in FIG. 8. Contrarily, if they are not desired to emit light, the applied voltage is $V_w-V_{pre}$ and the modulation voltage is $2V_{pre}$.

Although the respective picture elements out of the selected scanning electrodes are supplied with the voltage $\pm V_{pre}$, the voltage $V_{pre}$ is normally much lower than the threshold voltage $V_{th}$ with no emission of light. Subsequent to the sequential scanning the field refresh pulses are supplied via the drive circuit 100 and the diode array circuits 60 and 70. Under these circumstances all of the MOS transistors within the scanning side switching circuit 50 are held in the OFF stage and the counterpart within the data side switching circuit 40 are in the ON stage. The voltage level of the field refresh pulses is equal to the maximum brightness write voltage Vo supplied from the respective scanning electrodes and is applied across the thin-film EL display panel in a direction opposite to the write voltage. The picture elements which have been polarized by the application of the write voltage are enabled to emit light in response to the field refresh pulses since the field refresh pulses are superimposed on an electric field resulting from the polarization.

As stated above, according to the teachings of the present invention, all of the picture elements are charged with the voltage, which is half the modulation voltage V(i), via the diode array 30 having commonly connected anodes and the scanning side switching element array 50 from the data side pre-charge circuit 20, in order to apply the modulation voltage V(i) to the respective selected picture elements during the pre-charge mode.

Then, all of the scanning side electrodes are pulled up to the pre-charge voltage $V_{pre}$ via the common-anode diode arrays 60 and 70 from the scanning side pre-charge circuit 110. At the time of pulling up, the voltage $V_{pre}$ from the scanning side the switching elements connected to the non-selected lines within the data side switching element array 50 are turned conductive.

Through the above procedure the data side non-selected lines bear 0 volts and the selected lines bear the potential $2V_{pre}$, thus making it possible to apply the half modulation voltage twice to the EL panel in order to supply the very modulation voltage as a whole. Accordingly, power consumption incurring during the pre-charge mode is reduced from $2C\,(\frac{1}{2}V)^2$ to $\frac{1}{2}\,CV^2$.

By way of example, the inventors employed an EL display panel with 240 X-axis electrodes, 120 Y-axis electrodes, 2 lines per mm of resolution, a capacitance per picture element of 7 pF, an EL threshold voltage $V_{th}=150$ Volts and a maximum brightness voltage Vo=210 Volts. The panel was excited at a frame frequency of 100 Hz and a scanning frequency of 12 kHz. Power consumption was 6.0 W in total and more specifically 4.35 W during the precharge mode, 0.76 W during the write mode and 0.89 W during the refresh mode. In contrast to this, the conventional circuit arrangement consumed 10.1 W of power.

Whereas the present invention has been described with respect to specific embodiments thereof, it will be understood that various changes and modifications will be suggested to one skilled in the art, and it is intended to encompass such changes and modifications as fall within the scope of the appended claims.

We claim:

1. A display device comprising:

a thin-film EL display panel having a plurality of scanning side electrodes and a plurality of data side electrodes;

a scanning side selection circuit connected to said scanning side electrodes of said thin-film EL display panel;

a data side selection circuit connected to said data side electrodes of said thin-film EL display panel;

a first pre-charge circuit connected to said data side selection circuit for supplying a supply voltage lower than a modulation voltage from the data side electrodes to the thin-film EL display panel, said voltage representing a first pre-charge voltage;

a second pre-charge circuit connected to said scanning side electrodes for supplying a difference voltage approximately equal to the difference between said supply voltage and said modulation voltage from the scanning side electrodes to the thin-film EL display panel, said difference voltage representing a second pre-charge voltage; and a write circuit for supplying a write voltage to said scanning side electrode inclusive of the picture element to be written, said write voltage being supplied through the scanning side selection circuit connected to the scanning side electrodes and through the data side selection circuit connected to said data side electrodes.

2. A display device according to claim 1 further comprising a circuit for discharging the first and the second pre-charge voltages via the data side electrodes.

3. A method of driving a thin-film EL display panel having a plurality of scanning side electrodes and a plurality of data side electrodes, a scanning side selection circuit connected to said scanning side electrodes of said thin-film EL dislay panel, a data side selection circuit connected to said data side electrodes of said thin-film EL display panel, said method comprising the steps of:

supplying a supply voltage lower than a modulation voltage from the data side electrodes to the thin-film EL display panel, said supply voltage representing a first pre-charge voltage;

supplying a difference voltage approximately equal to the difference between said supply voltage and said modulation voltage from the scanning side electrodes to the thin-film EL display panel, said difference voltage representing a second pre-charge voltage; and supplying a write voltage to the scanning side electrode inclusive of the picture element to be written, said write voltage being supplied through the scanning side selection circuit connected to the scanning side electrodes and through the data side selection circuit connected to the data side electrodes.

* * * * *